US012123653B2

(12) United States Patent
Youn et al.

(10) Patent No.: US 12,123,653 B2
(45) Date of Patent: Oct. 22, 2024

(54) HEAT EXCHANGER

(71) Applicant: Hanon Systems, Daejeon (KR)

(72) Inventors: Han Gil Youn, Daejeon (KR); Seung Su Baek, Daejeon (KR); Sang Ok Lee, Daejeon (KR)

(73) Assignee: Hanon Systems, Daejeon (KR)

( * ) Notice: Subject to any disclaimer, the term of this patent is extended or adjusted under 35 U.S.C. 154(b) by 530 days.

(21) Appl. No.: 17/418,630

(22) PCT Filed: Dec. 20, 2019

(86) PCT No.: PCT/KR2019/018167
§ 371 (c)(1),
(2) Date: Jun. 25, 2021

(87) PCT Pub. No.: WO2020/138851
PCT Pub. Date: Jul. 2, 2020

(65) Prior Publication Data

US 2022/0065542 A1 Mar. 3, 2022

(30) Foreign Application Priority Data

Dec. 26, 2018 (KR) ..... 10-2018-0169254
Dec. 17, 2019 (KR) ..... 10-2019-0169008

(51) Int. Cl.
*F28D 1/053* (2006.01)
*F28D 21/00* (2006.01)
(Continued)

(52) U.S. Cl.
CPC ..... *F28D 1/05383* (2013.01); *F28D 21/00* (2013.01); *F28F 9/0246* (2013.01);
(Continued)

(58) Field of Classification Search
CPC ..... F28D 1/05383; F28D 2021/0085; F28F 9/0246; F28F 9/0204
See application file for complete search history.

(56) References Cited

U.S. PATENT DOCUMENTS 6,449,979 B1 * 9/2002 Nagasawa ..... F28D 1/05391 62/503
2010/0012307 A1 1/2010 Taras et al.
(Continued)

FOREIGN PATENT DOCUMENTS

CN 102261863 A * 11/2011
JP H10258332 A 9/1998
(Continued)

OTHER PUBLICATIONS

Translated_Lee (Year: 2016).*
(Continued)

*Primary Examiner* — Larry L Furdge
*Assistant Examiner* — Samba N M N Gaye
(74) *Attorney, Agent, or Firm* — Norton Rose Fulbright US LLP; James R. Crawford

(57) ABSTRACT

A heat exchanger including a first header tank and a second header tank that are disposed to be spaced apart a predetermined distance in a height direction and a core part that is disposed between the first header tank and the second header tank and includes a plurality of tubes and fins, the first header tank including a first header plate, a first tank, and a first partition wall that divides a space formed by a combination of the first header plate and the first tank to form a plurality of flow paths, the first partition wall being provided with a main communication hole and an auxiliary communication hole, and an area ratio of the auxiliary communication hole being 3 to 7% of an area of the main communication hole.

14 Claims, 17 Drawing Sheets

(51) Int. Cl.
*F28F 9/02* (2006.01)
*F28F 9/04* (2006.01)

(52) U.S. Cl.
CPC ..... *F28F 9/028* (2013.01); *F28F 9/04* (2013.01); *F28D 2021/0085* (2013.01); *F28F 9/0204* (2013.01)

(56) References Cited

U.S. PATENT DOCUMENTS

| | | | | |
|---|---|---|---|---|
| 2014/0069136 | A1* | 3/2014 | Lim | B60H 1/00778 62/436 |
| 2018/0128525 | A1* | 5/2018 | Bugler | F28C 1/14 |

FOREIGN PATENT DOCUMENTS

| | | | | | |
|---|---|---|---|---|---|
| JP | H11337293 | A | | 12/1999 | |
| JP | 3449897 | B2 | | 9/2003 | |
| JP | 2008256234 | A | | 10/2008 | |
| KR | 20010015060 | A | | 2/2001 | |
| KR | 2007115094 | A | * | 12/2007 | F28F 13/06 |
| KR | 20080103164 | A | | 11/2008 | |
| KR | 20080103293 | A | | 11/2008 | |
| KR | 2009038359 | A | * | 4/2009 | F28F 9/02 |
| KR | 20110133983 | A | | 12/2011 | |
| KR | 2016015673 | A | * | 2/2016 | F25B 39/02 |
| KR | 20160015673 | A | | 2/2016 | |

OTHER PUBLICATIONS

Translated_Ki (Year: 2007).*
Translated_Lu (Year: 2011).*
Translated_Young (Year: 2009).*
Office Action issued on Jun. 30, 2022 by the CIPO in the corresponding Patent Application No. CN 201980085463.3, with English translation.
Office Action issued on Nov. 27, 2023 by the Korean Patent OFfice in the corresponding Patent Application No. 10-2019-0169008, with English translation.

* cited by examiner

| Specification | Base | #1 | #2 | #3 | #4 | #5 |
|---|---|---|---|---|---|---|
| Specification of communication hole | Main communication hole : 192mm² Auxiliary communication hole X | Main communication hole : 192mm² Auxiliary communication hole : 38.5mm² area ratio of auxiliary communication hole : 20% | Main communication hole : 192mm² Auxiliary communication hole : 28.2mm² area ratio of auxiliary communication hole : 14.7% | Main communication hole : 192mm² Auxiliary communication hole : 19.6mm² area ratio of auxiliary communication hole 10.2% | Main communication hole : 192mm² Auxiliary communication hole : 12.6mm² area ratio of auxiliary communication hole : 6.5% | Main communication hole : 192mm² Auxiliary communication hole : 7.1mm² area ratio of auxiliary communication hole : 3.7% |
| Heat dissipation performance | 100% | 97.9% | 98.8% | 98.7% | 100.8% | 101.7% |
| temperature distribution: 18 sensors Max△T (℃) | 1.1 | 1.0 | 2.9 | 0.9 | 0.9 | 0.8 |
| temperature distribution: 9 right (communication hole portion) Max △T (℃) | 1.1 | 1.0 | 0.9 | 0.9 | 0.5 | 0.4 |
| temperature distribution: Raw data | 36 36 39 34 35 35<br>37 36 36 33 33 41<br>38 38 36 37 38 44 | 32 36 41 32 33 39<br>35 34 36 31 42 33<br>33 34 36 34 42 28 | 31 34 41 29 30 28<br>33 37 53 29 29 29<br>31 33 58 32 38 33 | 38 38 35 34 36 37<br>38 40 40 33 34 37<br>36 38 38 36 41 42 | 40 36 36 33 33 35<br>40 41 33 32 33 34<br>36 36 35 35 37 36 | 40 39 39 36 36 38<br>41 43 38 35 35 37<br>40 40 40 38 39 35 |
| thermal image | 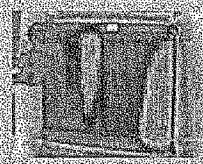 | 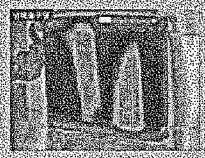 | 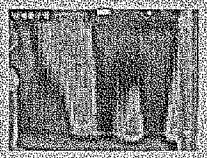 | 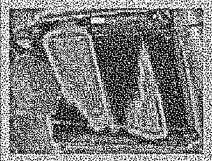 | 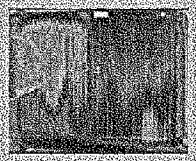 | 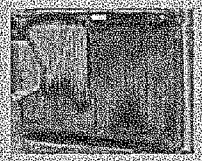 |

FIG. 6

HEAT EXCHANGER

CROSS REFERENCE TO RELATED APPLICATIONS

This application is a national phase under 35 U.S.C. § 371 of International Application No. PCT/KR2019/018167 filed on Dec. 20, 2019, which claims the benefit of priority from Korean Patent Application Nos. 10-2019-0169008 filed on Dec. 17, 2019 and 10-2018-0169254 filed on Dec. 26, 2018. The entire contents of these applications are incorporated herein by reference in their entirety.

TECHNICAL FIELD

The embodiment relates to a heat exchanger. More specifically, it relates to a heat exchanger, such as an evaporator, with improved performance through a structural change.

BACKGROUND ART

As global interest in energy and environmental issues grows, the efficiency of each part, including fuel economy, has been steadily improved in recent years in the automobile manufacturing industry, and the appearances of automobile are also diversifying in order to satisfy the needs of various consumers. In accordance with this trend, continuous research and development are being made for each component of a vehicle for lighter weight, miniaturization, and higher functionality. In particular, in a vehicle cooling system, since it is difficult to secure a sufficient space in an engine room, efforts have been made to manufacture a heat exchange system having a small size and high efficiency.

On the other hand, a heat exchange system generally includes a heat exchanger that absorbs heat from the surroundings, a compressor that compresses a refrigerant or heat medium, a condenser that discharges heat to the surroundings, and an expansion valve that expands the refrigerant or heat medium.

In the cooling system, the gaseous refrigerant flowing from the heat exchanger to the compressor is compressed at high temperature and high pressure in the compressor, and the heat of liquefaction is released to the surroundings while the compressed gaseous refrigerant passes through the condenser and is liquefied. The liquefied refrigerant passes through the expansion valve again to become a low-temperature and low-pressure wet-saturated vapor state, and then flows back into the heat exchanger and vaporizes to form a cycle. The actual cooling action occurs by the heat exchanger in which the liquid refrigerant absorbs the amount of heat as much as the heat of vaporization in the surroundings and is vaporized.

As described above, the low-temperature and low-pressure refrigerant passing through the expansion valve passes through a connection pipe and flows into the heat exchanger, and the refrigerant absorbs heat from the surroundings in the heat exchanger, resulting in high temperature and high pressure. Therefore, it is obvious that the heat exchanger must be of a material and structure capable of withstanding high temperature and high pressure as well as rapid phase change of the refrigerant contained therein.

As such, the heat exchanger is a core component of the cooling system, and the development of the heat exchanger is continuously conducted.

DETAILED DESCRIPTION OF INVENTION

Technical Problem

The purpose of the embodiment is to increase efficiency and reduce cost by changing the structure of a heat exchanger.

The problem to be solved by the present invention is not limited to the problems mentioned above, and other problems not mentioned herein will be clearly understood by those skilled in the art from the following description.

Solution to Problem

In the embodiment of the present invention, a heat exchanger may include a first header tank and a second header tank that are disposed to be spaced apart a predetermined distance in a height direction and a core part that is disposed between the first header tank and the second header tank and includes a plurality of tubes and fins. The first header tank may include a first header plate, a first tank, and a first partition wall that divides a space formed by a combination of the first header plate and the first tank to form a plurality of flow paths. The first partition wall may be provided with a main communication hole and an auxiliary communication hole, and an area ratio of the auxiliary communication hole may be 3 to 7% of an area of the main communication hole.

In another embodiment of the present invention, a heat exchanger may include a first header tank and a second header tank that are disposed to be spaced apart a predetermined distance in a height direction and a core part that is disposed between the first header tank and the second header tank and includes a plurality of tubes and fins. The second header tank may include a second header plate, a second tank, and a second partition wall that divides a space formed by a combination of the second header plate and the second tank to form a plurality of flow paths. A throttle including a throttle hole may be disposed in the flow path formed through the second partition wall, and the throttle may be spaced apart from one side of the second header tank.

Preferably, the throttle may have a separation distance of 55 to 70 mm from one side of the second header tank.

Preferably, the throttle hole may have a size of 10 to 20% of a total area of the throttle.

Preferably, the throttle may be provided with a third fixing portion and a fourth fixing portion, the third fixing portion may be fixed to the second header plate, and the fourth fixing portion may be inserted and fixed to the second tank.

Preferably, the fourth fixing portion may be provided with a fourth fixing groove, and a certain region of the second partition wall may be inserted and fixed in the fourth fixing groove.

Preferably, a second throttle fixing hole into which the fourth fixing portion is inserted may be disposed in the second tank, and the second throttle fixing hole may be disposed to span a space partitioned by the second partition wall.

Preferably, the tube may include a plurality of flow holes through a plurality of partitioning walls, and a thickness of an outermost wall of the tube may be thicker than a thickness of the partitioning wall.

Preferably, the thicknesses of the partitioning wall and the outermost wall may have a ratio of 1:1.9 to 2.1.

Preferably, the flow holes may be provided with 13 to 15.

Preferably, a ratio of width and height of the tube may be 1:0.08 to 0.085.

Preferably, the first header tank and the second header tank may have a two-row structure, and a baffle may be disposed inside the first header tank to form a 4-pass flow path.

Preferably, the throttle may be disposed in a first row and a second row of the second header tank, respectively.

Preferably, the second header tank may be divided into four zones through the baffle disposed in the first header tank, and the throttle may be disposed in a second zone and a fourth zone, respectively.

Preferably, the throttle may be disposed in a center of the zone.

Advantageous Effects of Invention

According to the embodiment, there is an effect of reducing the manufacturing cost of a heat exchanger compared to a conventional art.

In addition, there is an effect of improving the quality by improving prevention of leakage or fastening force.

In addition, there is an effect of increasing the heat exchange performance of a heat exchanger.

Various and beneficial advantages and effects of the present invention are not limited to the above description, and will be more easily understood in the course of describing specific embodiments of the present invention.

BRIEF DESCRIPTION OF DRAWINGS

FIG. 6 is a table showing the degree of improvement in heat dissipation performance according to the installation of an auxiliary communication hole.

EMBODIMENTS OF INVENTION

Figure 1:
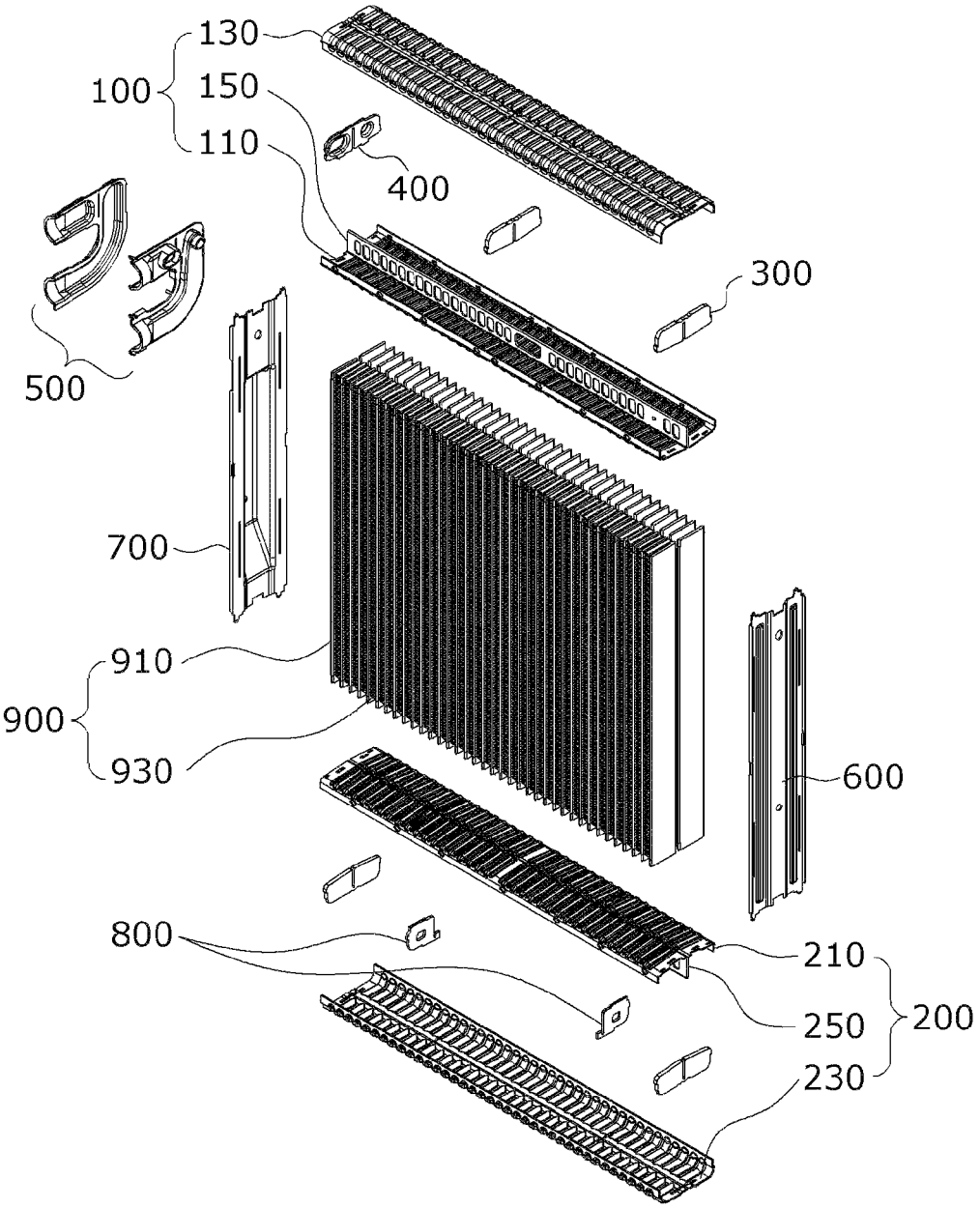
FIG. 1 is a view showing the structure of a heat exchanger according to an embodiment of the present invention.

Hereinafter, preferred embodiments of the present invention will be described in detail with reference to the accompanying drawings.

However, the technical idea of the present invention is not limited to some embodiments to be described, but may be implemented in various different forms, and within the scope of the technical idea of the present invention, one or more of the constituent elements may be selectively combined and substituted between the embodiments.

In addition, the terms (including technical and scientific terms) used in the embodiments of the present invention may be interpreted as meanings that can be generally understood by those of ordinary skill in the art to which the present invention belongs, unless explicitly defined and described. The terms generally used, such as terms defined in a dictionary, may be interpreted in consideration of the meaning in the context of the related technology.

In addition, the terms used in the embodiments of the present invention are for describing the embodiments and are not intended to limit the present invention.

In the present specification, the singular form may include the plural form unless specifically stated in the phrase, and when described as "at least one (or more than one) of A and (and) B and C", it may contain one or more of all possible combinations with A, B, and C.

In addition, terms such as first, second, A, B, (a), and (b) may be used in describing the constituent elements of the embodiment of the present invention.

These terms are only for distinguishing the constituent element from other constituent elements, and are not limited to the nature, order, or sequence of the constituent element by the term.

And, when a component is described as being 'connected', 'coupled' or 'contacted' to another component, not only it may include the case where the component is directly connected, coupled, or contacted to the other component, but also it may include the case of being 'connected', 'coupled' or 'contacted' due to another component between the component and the other component.

In addition, when it is described as being formed or disposed on the "top (upper) or bottom (lower)" of each component, not only it includes the case where two components are directly in contact with each other, but also it includes the case where one or more other component is formed or disposed between the two components. In addition, when expressed as "top (upper) or bottom (lower)", the meaning of not only an upward direction but also a downward direction based on one component may be included.

Hereinafter, exemplary embodiments will be described in detail with reference to the accompanying drawings, but the same reference numerals are assigned to the same or corresponding components regardless of the reference numerals, and redundant descriptions thereof will be omitted.

In order to clearly understand the present invention conceptually, FIGS. 1 to 26 clearly illustrate only the main characteristic parts, and as a result, various modifications of the illustration are expected, and the scope of the present invention does not have to be limited by the specific shape illustrated in the drawings.

FIG. 1 is a view showing the structure of the heat exchanger according to an embodiment of the present invention.

Referring to FIG. 1, the heat exchanger according to the embodiment of the present invention may include a first header tank 100 and a second header tank 200 disposed to be spaced apart a predetermined distance in a height direction, and a core part 900 that is disposed between the first header tank 100 and the second header tank 200 and includes a tube 910 and a fin 930.

The inside of the first header tank 100 and the second header tank 200 may be partitioned into a first flow path and a second flow path by a partition wall. A baffle 300 is provided inside the first header tank 100 and the second header tank 200 to control the flow of a refrigerant.

An end cap 400 is connected to one side of the first header tank 100, and a manifold 500 is connected to the end cap 400 to allow the refrigerant to flow in and out.

In addition, the second header tank 200 is provided with a throttle 800 to control the flow of the refrigerant.

The core part 900 including the tube 910 and the fin 930 is disposed between the first header tank 100 and the second header tank 200 so that heat exchange may occur.

A first end plate 600 and a second end plate 700 may be coupled to one side and the other side of the core part 900.

Figure 2:
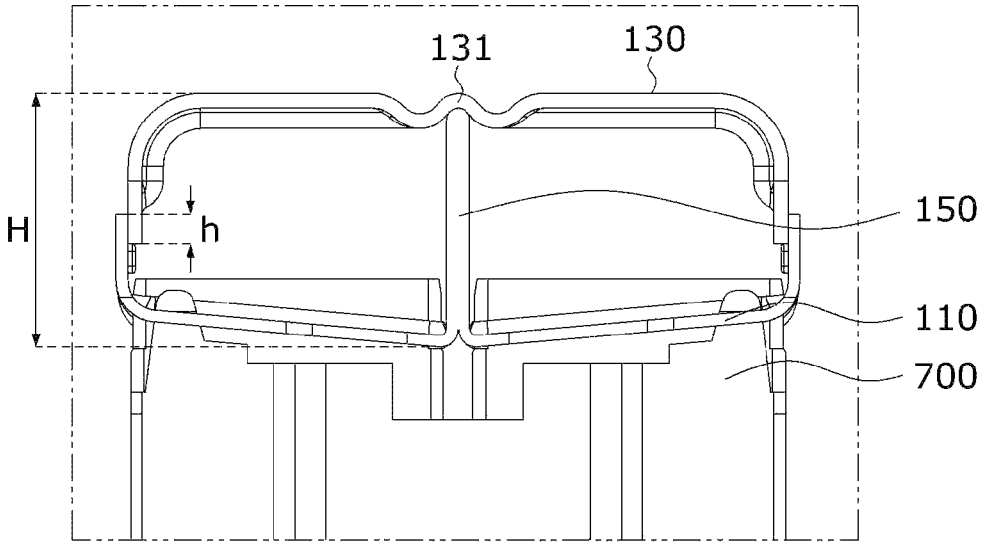
FIG. 2 is a view showing the coupling structure of the first header tank that is the component of FIG. 1.
Figure 3:
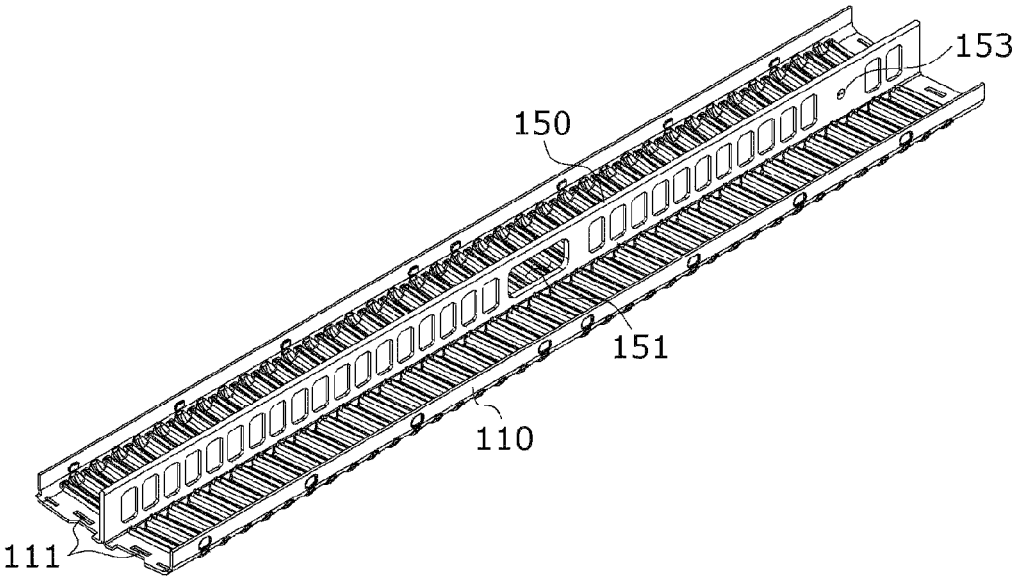
FIG. 3 is a view showing the structure of the partition wall that is the component of FIG. 1, FIGS. 4 and 5 are views showing the structure of the header that is the component of FIG. 1.
Figure 4:
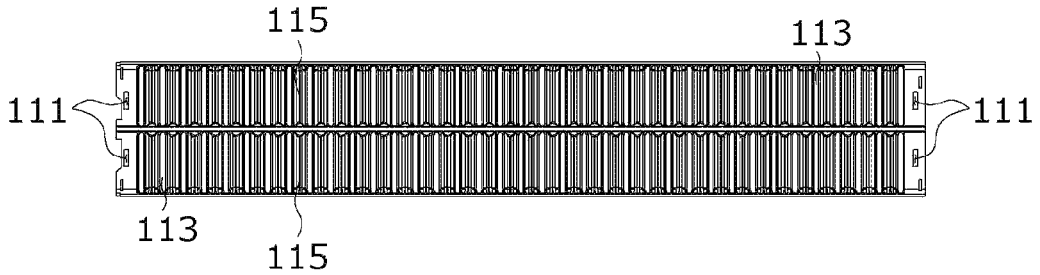
Figure 5:
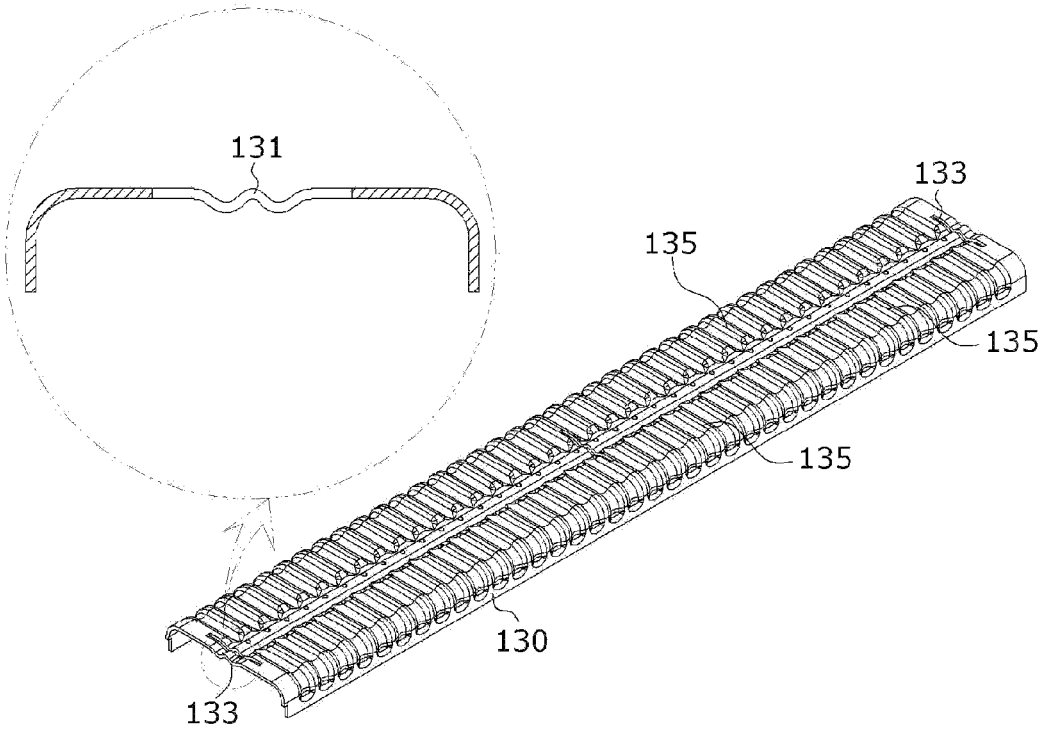

FIG. 2 is a view showing the coupling structure of the first header tank 100 that is the component of FIG. 1, FIG. 3 is a view showing the structure of the partition wall that is the component of FIG. 1, and FIGS. 4 and 5 are views showing the structure of the header that is the component of FIG. 1.

Referring to FIGS. 2 to 5, the first header tank 100 may form a header tank by combining a first header plate 110 and a first tank 130.

Both ends of the first header plate 110 may be bent and provided to have an inclination toward the center. In one embodiment, the first header plate 110 may have a symmetrical structure with respect to a center. The first header plate 110 may have an inclination angle of 4 to 6 degrees, preferably 5 degrees, and have a symmetrical structure with respect to a first partition wall 150. In the first header plate 110 having such an inclination, condensed water may flow along the inclination and be discharged.

A second end cap fixing hole 111 for fixing the end cap 400 may be formed at one end of the first header plate 110. In one embodiment, the second end cap fixing hole 111 may be provided on both sides with respect to the first partition wall 150, respectively.

The first partition wall 150 may be provided in the center of the first header plate 110. The first partition wall 150 may be provided in a separate structure and be coupled to the first header plate 110, but the first header plate 110 and the first partition wall 150 may be integrally coupled in order to prevent the leakage of the refrigerant moving inside the first header tank 100.

The first partition wall 150 may be connected to the first header plate 110 and provided to protrude to a predetermined height. The first partition wall 150 may divide the first header tank 100 to have a pair of flow paths.

The first header plate 110 may be provided with a plurality of tube coupling holes 113 on both sides with respect to the first partition wall 150.

The tube coupling hole 113 is formed in a direction perpendicular to the first partition wall 150, and the tube 910 may be inserted into the tube coupling hole 113. The shape of the plurality of tube coupling holes 113 is not limited, but the plurality of tube coupling holes 113 is provided symmetrically with respect to the first partition wall 150, and they are preferably provided in the same shape for uniform movement of the refrigerant and ease manufacturing.

In addition, an emboss 115 may be disposed between the tube coupling holes 113. In one embodiment, the emboss 115 may be formed in the same direction as the tube coupling hole 113 to supplement the rigidity of the first header plate 110.

The first partition wall 150 may be provided with a main communication hole 151 and an auxiliary communication hole 153. The main communication hole 151 and the auxiliary communication hole 153 connect the first and second passages formed by the first partition wall 150 to allow the refrigerant to move.

FIG. 6 is a table showing the degree of improvement in heat dissipation performance according to the installation of the auxiliary communication hole 153.

FIG. 6 compares the heat dissipation performance of a conventional case in which only the main communication hole 151 is used with the heat dissipation performance when the auxiliary communication hole 153 is used.

The effect of the auxiliary communication hole 153 was tested based on the heat dissipation performance in the conventional case of using the main communication hole 151.

Referring to Experimental Data #1, when the area of the auxiliary communication hole 153 had an area of 20% based on the area of the main communication hole 151, the heat dissipation performance was decreased to 97.9%.

Referring to Experimental Data #2, when the area of the auxiliary communication hole 153 had an area of 14.7% based on the area of the main communication hole 151, the heat dissipation performance was decreased to 98.8%.

Referring to Experimental Data #3, when the area of the auxiliary communication hole 153 had an area of 10.8% based on the area of the main communication hole 151, the heat dissipation performance was decreased to 98.7%.

Referring to Experimental Data #4, when the area of the auxiliary communication hole 153 had an area of 6.5% based on the area of the main communication hole 151, the heat dissipation performance was increased to 100.8%.

Referring to Experimental Data #5, when the area of the auxiliary communication hole 153 had an area of 3.7% based on the area of the main communication hole 151, the heat dissipation performance was increased to 101.7%.

Considering the above experimental data (#1 to #5), it can be confirmed that the heat dissipation performance varies depending on the area of the auxiliary communication hole 153 arranged to be spaced apart a predetermined distance from the main communication hole 151 disposed in the partition wall for the passage of the refrigerant. It can be seen that the heat dissipation performance is not improved simply by providing the auxiliary communication hole 153, but the performance is improved only when the area of the auxiliary communication hole is within a certain area range compared to the main communication hole 151.

In the present invention, the shape of the auxiliary communication hole 153 is shown in a circular shape, but this is only an embodiment and may be modified into various shapes.

When the area ratio of the auxiliary communication hole 153 is more than 10% of the area of the main communication hole 151, it is confirmed that the refrigerant is more concentrated in the auxiliary communication hole 153 than necessary, resulting in deterioration of the refrigerant distribution, thereby deteriorating the flame retardant performance.

In the present invention, when the area ratio of the auxiliary communication hole 153 is 3 to 7% compared to the main communication hole 151, the distribution of the refrigerant passing through the communication hole is improved, and accordingly, it is confirmed that the heat dissipation performance is improved in the range of 0.8 to 1.7%.

The first tank 130 may have a structure in which both ends are bent, and a concave portion 131 into which a partition wall is inserted and disposed may be provided in a certain region of the center.

The concave portion 131 may be provided along the longitudinal direction of the first header tank 100 and may be closely coupled to the first partition wall 150. The concave portion 131 and the first partition wall 150 may divide a flow path partitioned by the first partition wall 150 through the close contact, but are not limited thereto and may be coupled through brazing welding. In addition, the concave portion 131 is arranged in a structure in which a valley and a floor are repeated, so that the utilization of a limited space may be increased.

An emboss 135 may be disposed on the first tank 130 to be disposed to face the emboss 115 disposed on the first header plate 110. The emboss 135 may supplement the rigidity of the first tank 130.

In addition, a first end cap fixing hole 133 for coupling the end cap 400 may be provided on one side of the first tank 130.

The bent region of the first header plate 110 and the bent region of the first tank 130 are arranged to overlap each other, and the overlapping region may form a sealed structure by brazing welding.

At this time, the maximum height (H) of the first header tank 100 and the height (h) of the region where the first header plate 110 and the first tank 130 are welded can be arranged to have the range of 1:0.115 to 1:0.125.

In the conventional header tank, the header plate has a flat structure, and the height of the header tank and the height of the region where the header plate and the tank are welded are arranged to have a ratio of 1:0.15 to 1:0.16.

However, in the present invention, the first header plate 110 is provided to have an inclination for discharging condensed water, and the height of the region to be welded is secured without changing the overall height.

In addition, the first header tank 100 forms a flow path having various paths using the baffle 300. Conventionally, the baffle 300 has a structure that is inserted into a groove formed in the tank.

However, in such a conventional structure, the embossed structure is not applied in order to form the groove so that there is a problem of deterioration of the durability.

In the present invention, in order to solve the durability problem, the conventional groove is removed and the whole is changed to an embossed structure, and the assembly is formed by inserting the baffle 300 into the emboss, thereby improving the durability compared to the conventional art.

Figure 7:
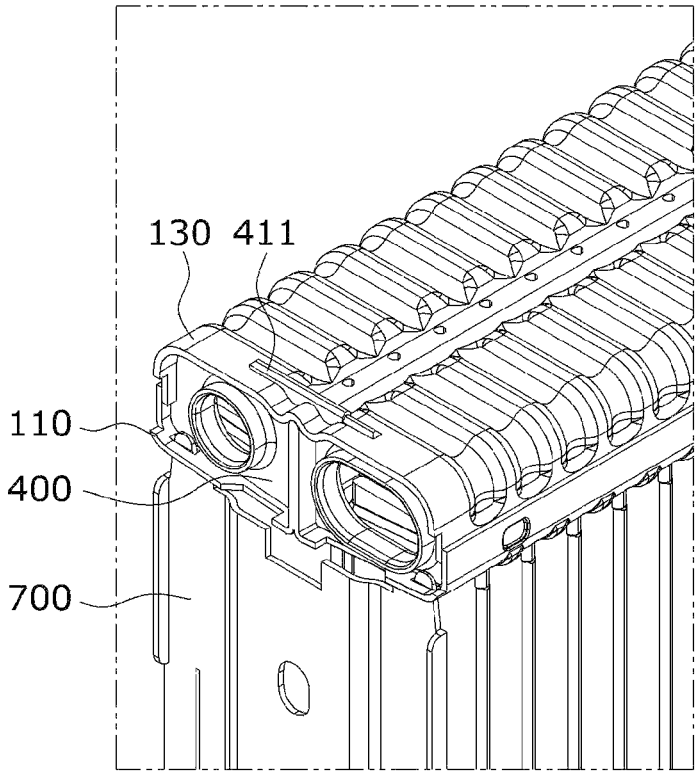
FIG. 7 is a perspective view of the combination of the first header tank and the end plate among the components of FIG. 1.
Figure 8:
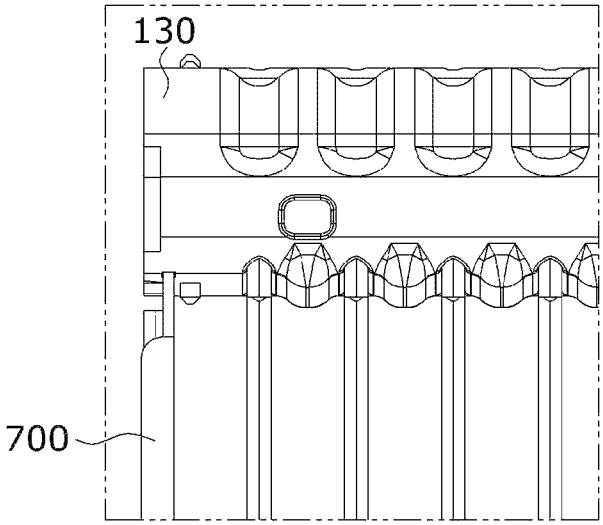
FIG. 8 is a side view of FIG. 7.
Figure 9:
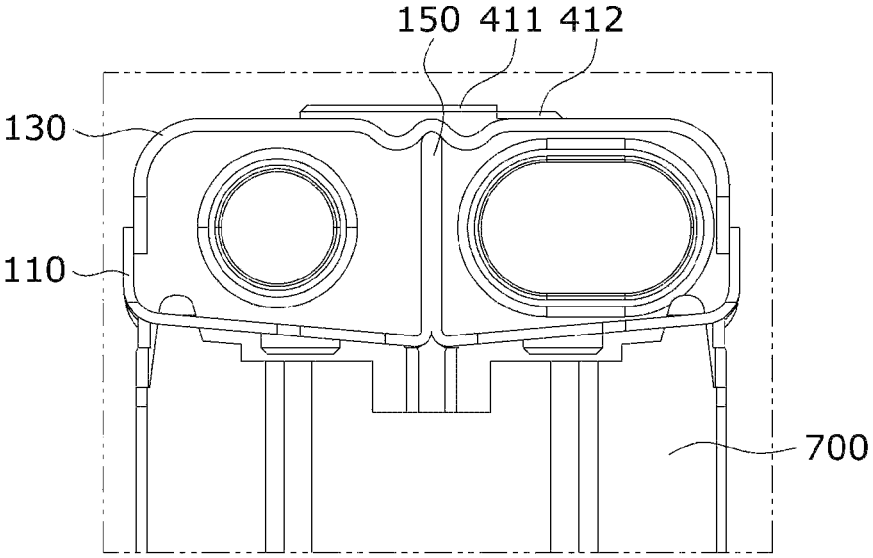
FIG. 9 is a front view of FIG. 7.
Figure 10:
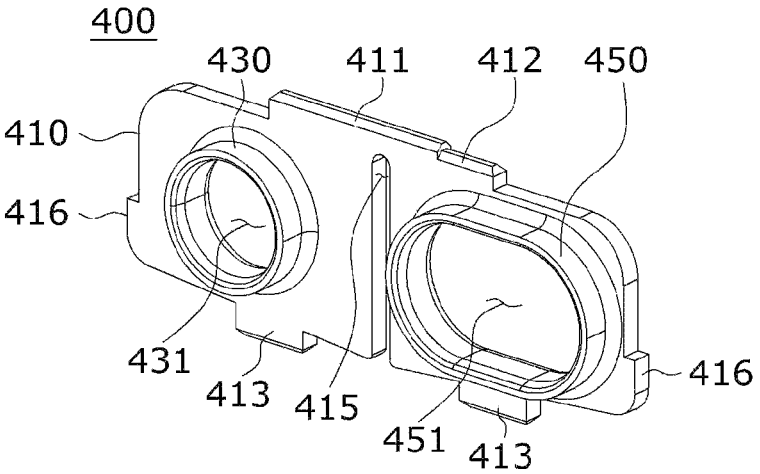
FIG. 10 is a perspective view of the end cap that is the component of FIG. 7.
Figure 11:
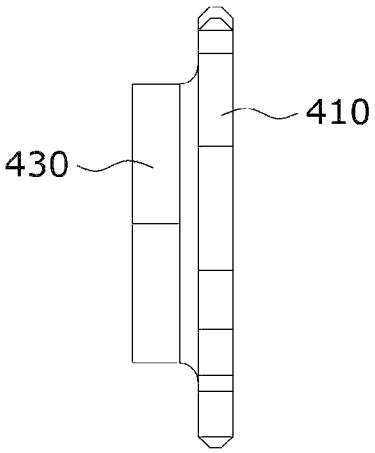
FIG. 11 is a side view of FIG. 10.
Figure 12:
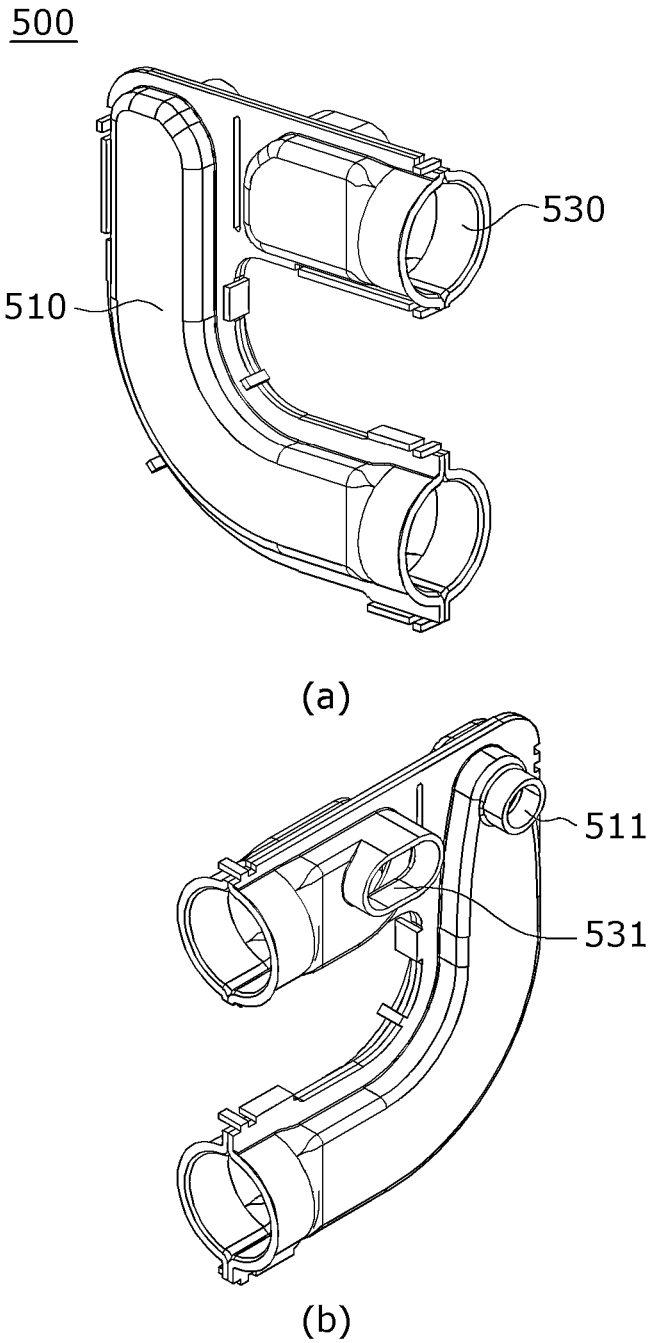
FIG. 12 is a perspective view of the manifold that is the component of FIG. 1.
Figure 13:
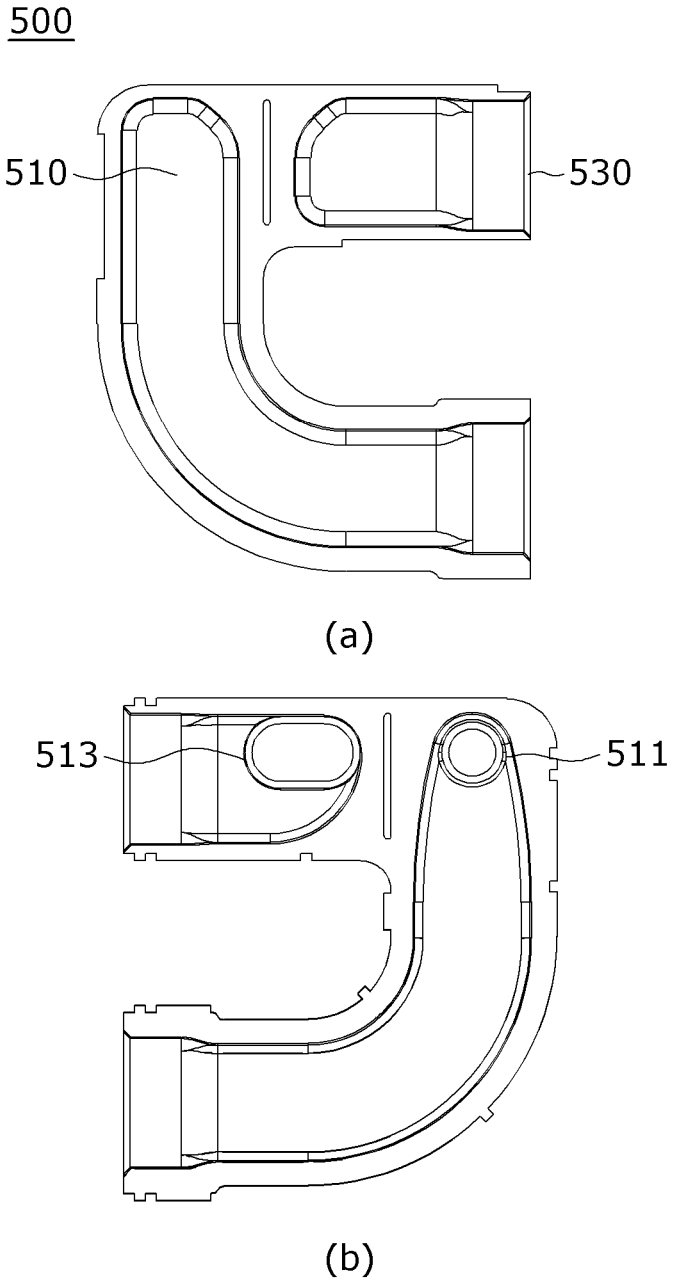
FIG. 13 is an exploded view of FIG. 12.
Figure 14:
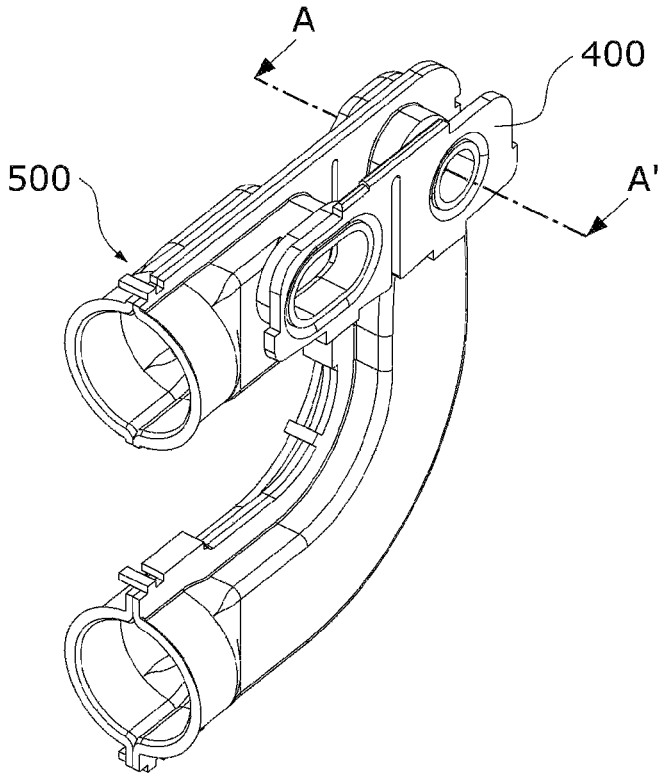
FIG. 14 is a view showing the combination of the manifold and the end cap that are the components of FIG. 1.
Figure 15:
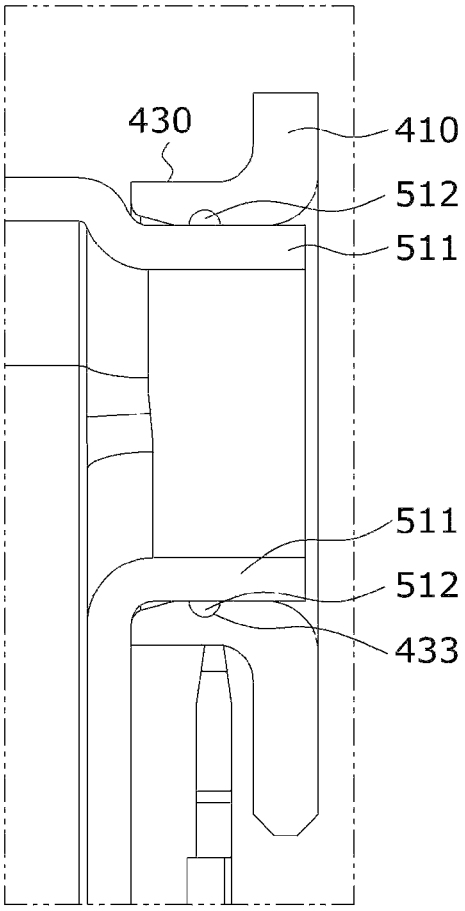
FIG. 15 is a cross-sectional view of A-A' of FIG. 14.

FIG. 7 is a perspective view of a combination of the first header tank 100 and the first end plate that are among the components of FIG. 1, FIG. 8 is a side view of FIG. 7, FIG. 9 is a front view of FIG. 7, FIG. 10 is a perspective view of the end cap 400 that is the component of FIG. 7, FIG. 11 is a side view of FIG. 10, FIG. 12 is a perspective view of the manifold 500 that is the component of FIG. 1, FIG. 13 is an exploded view of FIG. 12, FIG. 14 is a view showing the coupling of the manifold 500 and the end cap 400, which are the components of FIG. 1, and FIG. 15 is a cross-sectional view of the combined state of FIG. 14.

Referring to FIGS, 7 to 15, the end cap 400 is connected to one side of the first header tank 100, and the end cap 400 is combined with the manifold 500 to allow inflow and outflow of refrigerant.

The end cap 400 may include an end cap plate 410, an inlet 431 that passes through the end cap plate 410 and through which the refrigerant flows into the first header tank 100, and an outlet 451 through which the refrigerant in the first header tank 100 is discharged.

The end cap plate 410 may be inserted and fixed inside a predetermined distance from the end of the first header tank 100. The end cap plate 410 may be provided in the same cross-sectional shape as the inner space of the first header tank 100.

The end cap plate 410 may be provided with a plurality of fixing portions for fixing with the first header tank 100. In one embodiment, a first fixing portion 411 may be provided on a surface of the end cap plate 410 in contact with the first tank 130, and a pair of second fixing portions 413 may be provided on a surface of the end cap plate 410 in contact with the first header plate 110.

The first fixing portion 411 may be inserted and fixed in the first end cap fixing hole 133 formed in the first tank 130. The first fixing portion 411 may be formed to span a first flow path and a second flow path partitioned by the partition wall, and a confusion prevention portion 412 for preventing confusion in the insertion direction may be provided at one side. In one embodiment, the confusion prevention portion 412 may be provided to have a step so as to prevent mis-assembly during assembly.

An insertion groove 415 through which the first partition wall 150 is inserted may be formed under the first fixing portion 411. The insertion groove 415 may be provided to have the same height as the height of the first partition wall 150 in the region where the end cap plate 410 is disposed, thereby forming a sealing structure.

In addition, the second fixing portion 413 may be respectively disposed on both sides of the insertion groove 415 to be inserted and fixed into the second end cap fixing hole 111 formed in the first header plate 110.

A surface of the end cap plate 410 in contact with the first header plate 110 may be provided to have the same inclination as the inclined surface formed on the first header plate 110.

In addition, a close coupling portion 416 may be provided on each of both sides of the end cap plate 410. The close coupling portion 416 serves to seal the step region generated when the first tank 130 and the first header plate 110 are coupled. The shape of the close coupling portion 416 may be provided in the same shape as the step region generated by the coupling of the first tank 130 and the first header plate 110.

An inflow coupling protruding portion 430 may have the inlet 431 through which the refrigerant can move in the center, be coupled with the inflow passage 510 provided in the manifold 500, and be protruded outward when coupled to the first header tank 100. The shape of the inflow coupling protruding portion 430 may be provided in the same shape as the shape of the inflow passage 510 formed in the manifold 500.

An outflow coupling protruding portion 450 may have an outlet 451 through which the refrigerant can flow out in the center, be coupled with an outflow passage 530 provided in the manifold 500, and be protruded outward when coupled to the first header tank 100.

The manifold 500 may include the inflow passage 510 through which refrigerant flows into the first header tank 100 and the outflow passage 530 through which the refrigerant of the second header tank 200 is discharged.

The inflow coupling protruding portion 430 and the outflow coupling protruding portion 450 may be connected to the ends of the inflow passage 510 and the outflow passage 530.

In one embodiment, an inflow passage protruding portion 511 may be inserted into the inflow coupling protruding portion 430, and an outflow passage protruding portion 531 may be inserted into the outflow coupling protruding portion 450. In this case, the inflow passage 510 is connected to the inlet 431, and the outlet passage 530 is connected to the outlet 451 so that the refrigerant may flow into and out of the first header tank 100.

The inflow passage 510 and the outflow passage 530 may have different areas. The inflow passage 510 may have a smaller area than that of the outflow passage 530. The cross sections of the inflow passage 510 and the outflow passage 530 may be provided to have a ratio of 1:3.5 to 4.9.

In one embodiment, when the area of the outflow passage 530 is set to 138 $mm^2$, the inflow passage 510 may have an area of 28 to 38 $mm^2$.

The shapes of the inflow passage 510 and the outflow passage 530 are not limited, but the inflow passage 510 may be provided to have a circular shape in order to smooth the flow of the incoming refrigerant.

The outflow coupling protruding portion 450 and the outflow passage 530 may be combined in the same structure as the coupling structure of the inflow coupling protruding portion 430 and the inflow passage 510. Hereinafter, a description will be made focusing on the coupling structure of the inflow coupling protruding portion 430 and the inflow passage 510.

The inflow passage protruding portion 511 may be inserted and fixed into the inflow coupling protruding portion 430. The inner surface of the inflow coupling protruding portion 430 and the outer surface of the inflow coupling protruding portion 430 may be provided in the same shape and be closely coupled.

At this time, the insertion depth (D) of the inflow passage protruding portion 511 may be set in a range of 3.8 to 4.2 mm to secure assembly strength and maximize space efficiency.

The end of the inner surface of the inflow coupling protruding portion 430 may have a curved surface or an inclined surface. Through this, it can easily facilitate the coupling of the inflow passage protruding portion 511.

In addition, a coupling protrusion 512 may be provided in a certain region of the outer circumferential surface of the inflow passage protruding portion 511. This can increase a bonding force and prevent separation. The coupling protrusion 512 may be provided on an end of the inflow passage protruding portion 511 or may be provided in a certain region of the center.

When the coupling protrusion 512 is provided on the end of the inflow passage protruding portion 511, the coupling protrusion 512 may be supported by the inner wall of the inflow coupling protruding portion 430. In addition, when the coupling protrusion 512 is provided in a certain region of the central portion of the inflow passage protruding portion 511, a coupling groove portion 433 may be formed on the inner surface of the inflow coupling protruding portion 430. The coupling groove portion 433 may be provided in a shape that matches the coupling protrusion 512, and may be deformed into various shapes.

Figure 16:
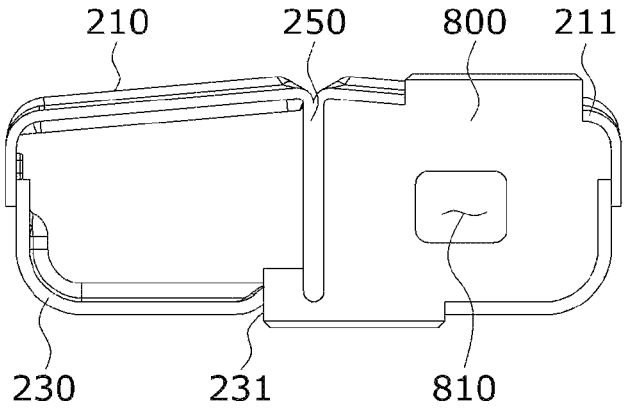
FIG. 16 is a view showing a structure in which the header tank and the throttle of FIG. 1 are coupled.
Figure 17:
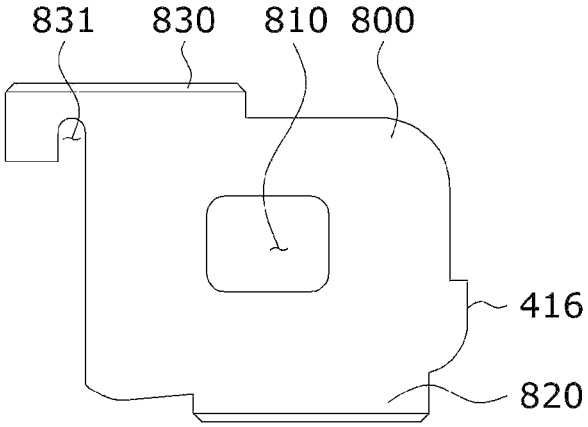
FIG. 17 is a cross-sectional view of the throttle that is the component of FIG. 16.

FIG. 16 is a view illustrating a structure in which the second header tank 200 and throttle 800 of FIG. 1 are coupled, and FIG. 17 is a cross-sectional view of the throttle 800 that is the component of FIG. 16.

Referring to FIGS. 16 and 17, the throttle 800 may be disposed in a certain region of the second header tank 200 partitioned through a second partition wall 250. The second header tank 200 may have the same structure as the first header tank 100.

The basic structure of the throttle 800 has a structure that is inserted and fixed in the first flow path or the second flow path divided through the second partition wall 250, and the close coupling portion 416 for sealing the outside may be provided.

A throttle hole 810 may be disposed in a certain region of the center of the throttle 800 to control the flow of the refrigerant. The throttle 800 prevents the refrigerant from shifting to an end when it is moved, thereby increasing the efficiency of refrigerant distribution. The throttle 800 may be disposed at a position spaced by a predetermined distance from the end of the flow path of the second header tank 200 (based on the flow of the flow path). In one embodiment, the throttle 800 may be disposed to have a separation distance of 55 to 70 mm from one side of the second header tank 200.

The throttle hole 810 may be formed to have a size of 10 to 20% of the total area of the throttle 800. There is no limit to the shape of the throttle hole 810, and it is preferable to be disposed at the center of the area of the throttle 800.

The throttle 800 may include a third fixing portion 820 and a fourth fixing portion 830 for fixing the throttle 800.

The third fixing portion 820 may be inserted into a first fixing hole 211 of the throttle 800 formed in the second header plate 210.

The fourth fixing portion 830 may be inserted into a second throttle fixing hole 231 formed in the second tank 230, and the second throttle fixing hole 231 may be arranged in the second tank 230 so as to span a space divided by the second partition wall 250.

The fourth fixing portion 830 may be provided with a fourth fixing groove 831 so that a certain region of the second partition wall 250 may be inserted. In this case, the fourth fixing portion 830 may be provided in a hook structure.

The throttle 800 may have a left-right symmetric structure so that it can be used for common use when the positions of the first flow path and the second flow path are changed.

Figure 18:
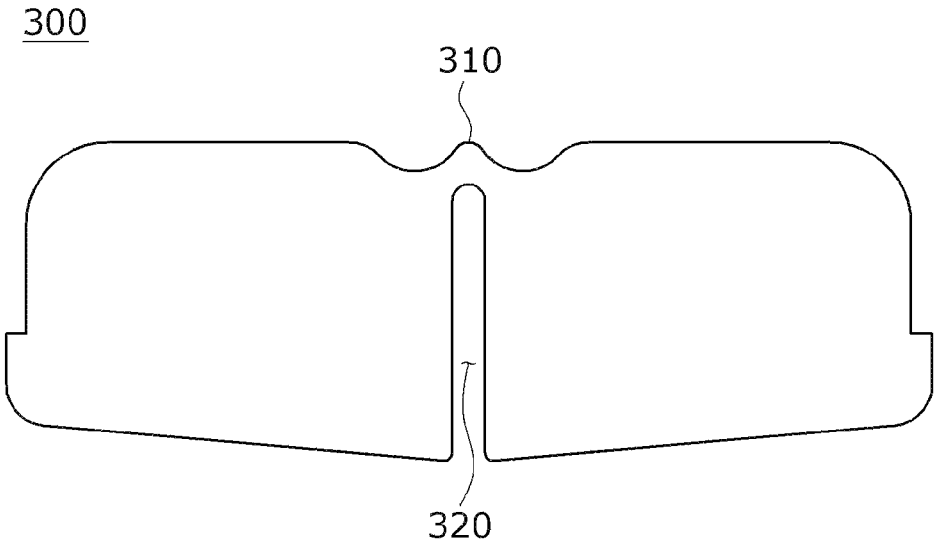
FIG. 18 is a view showing the structure of the baffle that is the component of FIG.

FIG. 18 is a view showing the structure of the baffle 300 that is the component of FIG. 1.

Referring to FIG. 18, the baffle 300 may be provided in the first header tank 100 or the second header tank 200 to control the flow of the refrigerant. The baffle 300 may be provided in a plate shape that blocks the flow of refrigerant in the longitudinal direction of the first header tank 100 or the second header tank 200, and can control the flow of the refrigerant moving through the core part 900.

In the baffle 300, a first partition wall insertion groove 320 may be formed in a certain region of the center so that the first partition wall 150 is inserted, and a concave insertion portion 310 that is in close contact with the concave portion 131 formed in the first tank 130 may be disposed on the side opposite to the first partition wall insertion groove 320.

The baffle 300 may have a structure that is closely coupled to an inner space where the first header plate 110 and the first tank 130 are coupled, and through this, the baffle 300 may be disposed at various positions.

Figure 19:
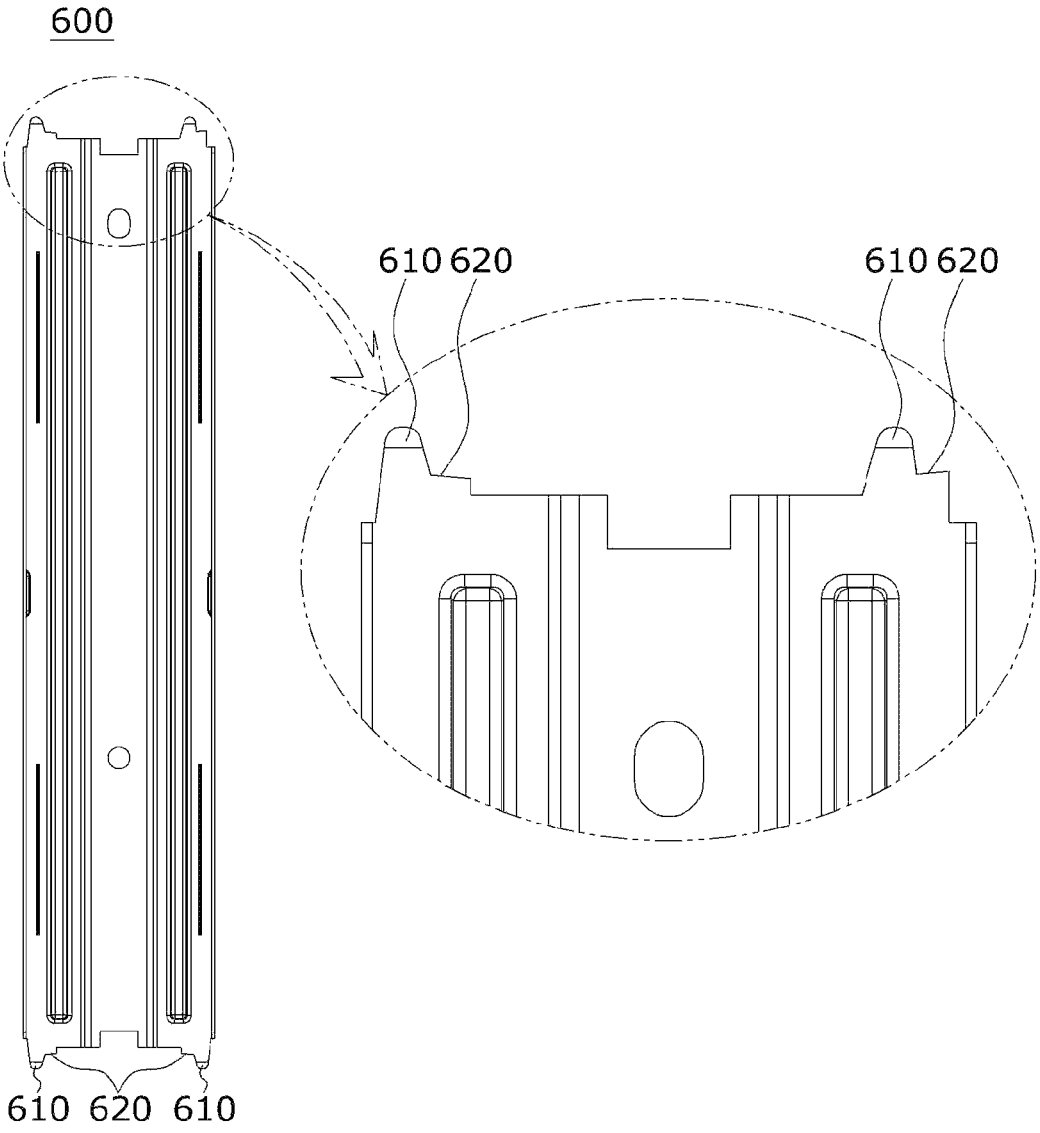
FIG. 19 is a view showing the structure of the first end plate that is the component of FIG. 1.
Figure 20:
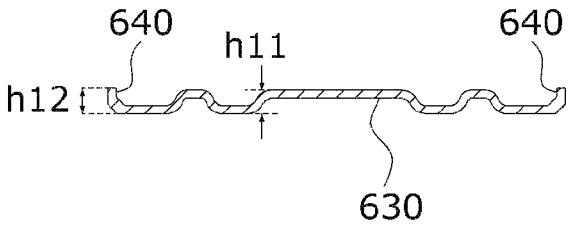
FIG. 20 is a cross-sectional view of FIG. 19.

FIG. 19 is a view showing the structure of the first end plate 600 that is the component of FIG. 1, and FIG. 20 is a cross-sectional view of FIG. 19.

Referring to FIGS. 7, 9, 19 and 20, the first end plate 600 can support the core part 900 at one side of the core part 900 consisting of the tube 910 and the fin 930. The first end plate 600 may be disposed on a side opposite to the side to which the manifold 500 is coupled.

A plurality of first fixing protrusions 610 inserted into the first fixing grooves respectively provided in the first header tank 100 and the second header tank 200 may be provided on both ends of the first end plate 600. In addition, a first inclined portion 620 may be provided on a side surface of the first fixing protrusion 610.

The arrangement of the first fixing protrusion 610 and the first inclined portion 620 coupled to the first header tank 100 may be different from the arrangement of the first fixing protrusion 610 and the first inclined portion coupled to the second header tank 200.

In one embodiment, the first fixing protrusion 610 coupled to the first header tank 100 and the first inclined portion 620 may be disposed on the same side. The arrangement of the first inclined part 620 may have the same inclination as that of the first header plate 110. In addition, the first fixing protrusion 610 coupled to the second header tank 200 and the first inclined portion 620 may be disposed on opposite sides to each other. This may prevent misassembly when assembling the first end plate 600, and at the same time serve as a stopper.

The first fixing protrusion 610 may be vertically coupled to the first header plate 110. At this time, the position at which the first fixing protrusion 610 is coupled is disposed outside the end cap plate 410, and thus, the leakage due to the defective welding occurring during blazing welding can be prevented.

The first end plate 600 may increase the supporting force by using a plurality of bending structures. The bending structure may be provided as a bent structure or a structure in which a certain region is recessed.

The first end plate 600 may include a first central bending portion 630 and a first outer bending portion 640 at each of both ends of the first central bending portion 630, and at least one first additional bending portion may be provided between the first central bending portion 630 and the first outer bending portion 640.

The height of the first central bending portion 630 may be lower than that of the first outer bending portion 640. The first outer bending portion 640 is provided on both sides of the first central bending portion 630 and may be bent at an angle of 90 degrees.

In one embodiment, when the first outer bending portion 640 has a height of 2.5 mm, the first central bending portion 630 may be designed to have a height of 1.8 to 2.3 mm.

Figure 21:
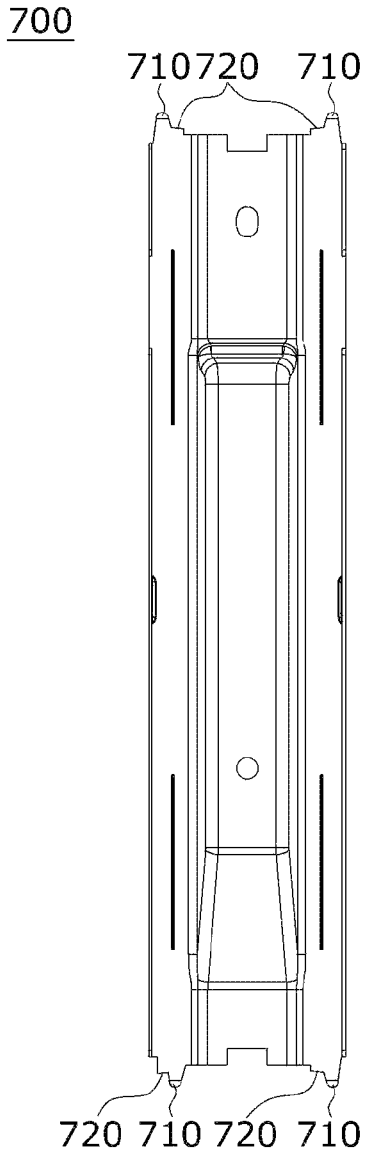
FIG. 21 is a view showing the structure of the second end plate that is the component of FIG. 1.
Figure 22:
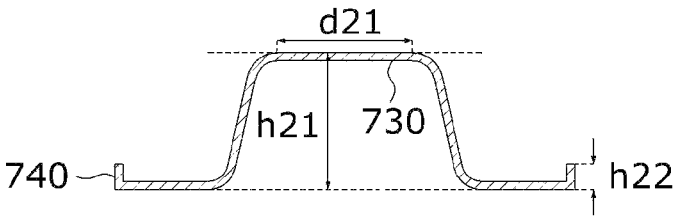
FIG. 22 is a cross-sectional view of FIG. 21.

FIG. 21 is a view showing the structure of the second end plate that is the component of FIG. 1, and FIG. 22 is a cross-sectional view of FIG. 21.

Referring to FIGS. 21 and 22, the second end plate 700 may support the core part 900 on the opposite side of the first end plate 600. The second end plate 700 may have a structure in which a certain region of the center protrudes in order to secure a space for coupling the manifold 500.

A second fixing protrusion 710 and a second inclined portion 720 provided on the second end plate 700 may be disposed to have the same structure as the first end plate 600.

The second end plate 700 may include a second central bending portion 730 and a second outer bending portion 740 provided on each of both sides of the second central bending portion 730.

The second central bending portion 730 may be set to have a height higher than that of the first central bending portion 630, and may have a flat area having a predetermined width to secure a supporting force.

In one embodiment, the second central bending portion 730 may be set to have a height ($h_{21}$) of 13.0 to 13.5 mm, and may include a flat area ($d_{21}$) of 10 mm or more.

In addition, the height ($h_{22}$) of the second outer bending portion 740 may be set to have a height lower than the height ($h_{21}$) of the second central bending portion 730. In one embodiment, the second outer bending portion 740 may be set to have a height of 2.5 mm.

Figure 23:
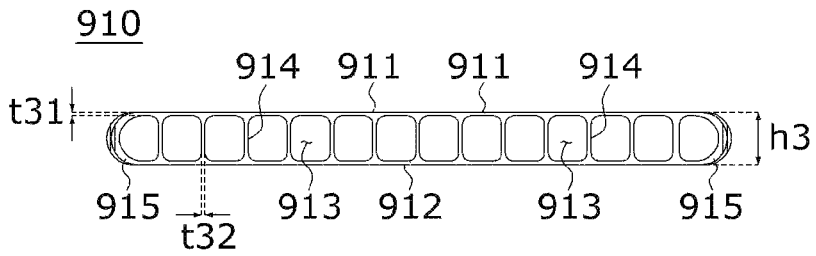
FIG. 23 is a cross-sectional view of the tube that is the component of FIG. 1.
Figure 24:
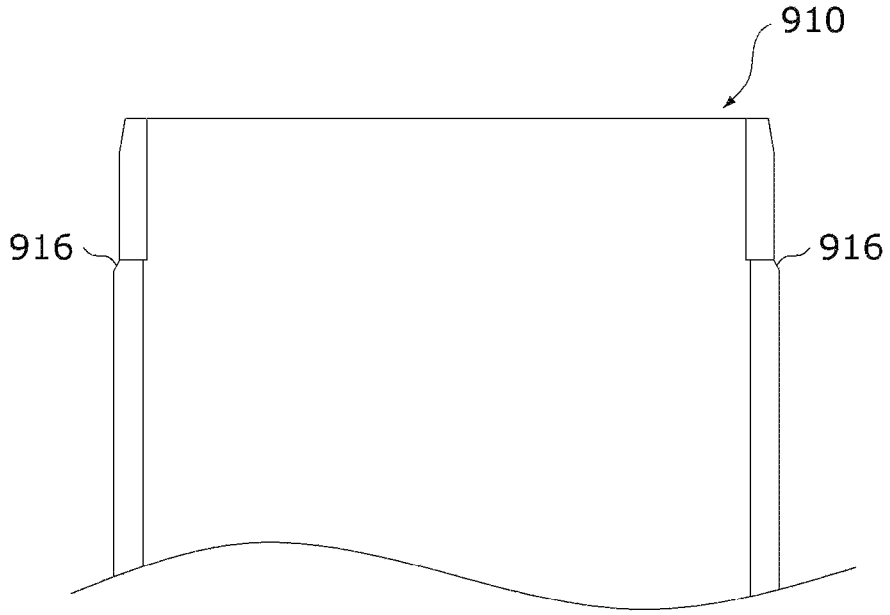
FIG. 24 is a side view of FIG. 1.

FIG. 23 is a cross-sectional view of the tube 910 that is the component of FIG. 1, and FIG. 24 is a side view of FIG. 1.

Referring to FIGS. 23 and 24, the tube 910 that is the component of the core, may be connected to the first header tank 100 and the second header tank 200 to provide a passage through which the refringent moves.

The tube 910 may be provided with multiple, and may be inserted and fixed in a tube coupling hole 113 formed in the header plate disposed to face each other in the first header tank 100 and the second header tank 200.

In the conventional heat exchanger structure, the tubes 910 of about 30 are arranged, but in the present invention, the number of tubes 910 is increased by reducing the thickness ($h_3$) of the tubes 910. As a result, the area that can be heat-exchanged through the refrigerant is increased, thereby increasing the efficiency of the heat exchanger. The width of the tube and the height of the tube may be set to have a ratio of 1:0.08 to 0.085.

In one embodiment, the height ($h_3$) of the tube 910 may have a height of 1.75 to 1.85 mm.

A plurality of flow holes 913 may be disposed in the tube 910. In the present invention, the height of the tube 910 is reduced and the number of flow holes 913 is increased accordingly. Compared to the conventional tube 910 structure, as the number of holes increases, the resistance of the fluid increases, thereby increasing the performance of heat exchange.

In one embodiment, fourteen flow holes 913 may be disposed in the tube 910.

The thickness ($t_{31}$) of the upper wall 911 and the lower wall 912 of the tube 910 may be set to have a thickness of 0.22 mm, and the thickness ($t_{32}$) of a partitioning wall 914 may have 0.15 mm. This can reduce cost compared to the conventional tube structure.

Further, the outermost wall 915 disposed on both sides of the tube 910 may be provided thicker than the thickness of the upper wall 911 and the lower wall 912. This is to solve the problem of water leakage due to corrosion in the outermost wall 915 when the heat exchanger is used.

In one embodiment, the outermost wall 915 of the tube 910 may be set to have a thickness of 1.9 to 2.1 times the thickness of the partitioning wall 914. When the thickness of the partitioning wall 914 is 0.15 mm, the thickness of the outermost wall 915 may be set to 0.3 mm.

Both ends of the tube 910 may be provided with a locking portion 916. This is to adjust the depth at which the tube 910 is inserted into the tube coupling hole 113, and the end may have an inclined or curved structure to facilitate insertion.

Figure 25:
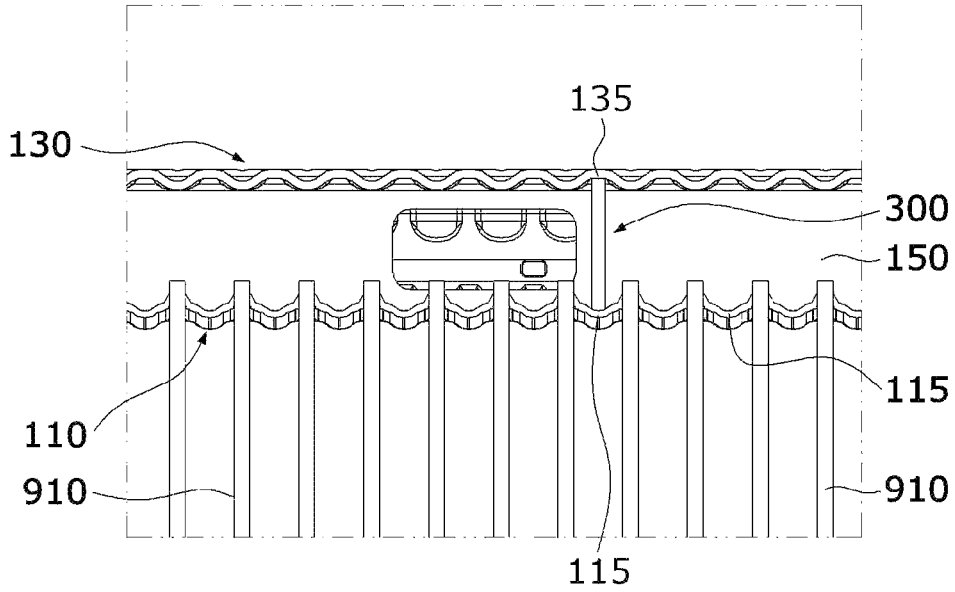
FIG. 25 is a view showing the coupling structure of the baffle that is the component of FIG. 1.

FIG. 25 is a view illustrating the coupling structure of the baffle that is the component of FIG. 1.

Referring to FIG. 25, the baffle 300 may be disposed between the first header plate 110 and the embosses 115 and 135 disposed to face the first tank 130.

Conventionally, grooves are provided in the first header plate and the first tank, respectively, to fix the baffle. In this structure, an emboss is difficult to be formed in the portion where the baffle is inserted, and there is a problem that the rigidity is weakened in the region where the emboss is not formed.

In order to solve this problem, the present invention forms the embosses 115 and 135 on the entire first header plate 110 and the first tank 130 to supplement rigidity, and has the structure in which the baffle 300 is disposed and fixed between the emboss 115 and the emboss 135.

In one embodiment, the baffle 300 may be disposed to be in close contact with the inside of the embosses 115 and 135 through surface contact.

By omitting the conventional coupling groove, the position of the baffle 300 can be adjusted as necessary, and the number or position of the flow path can be variously formed.

Figure 26:
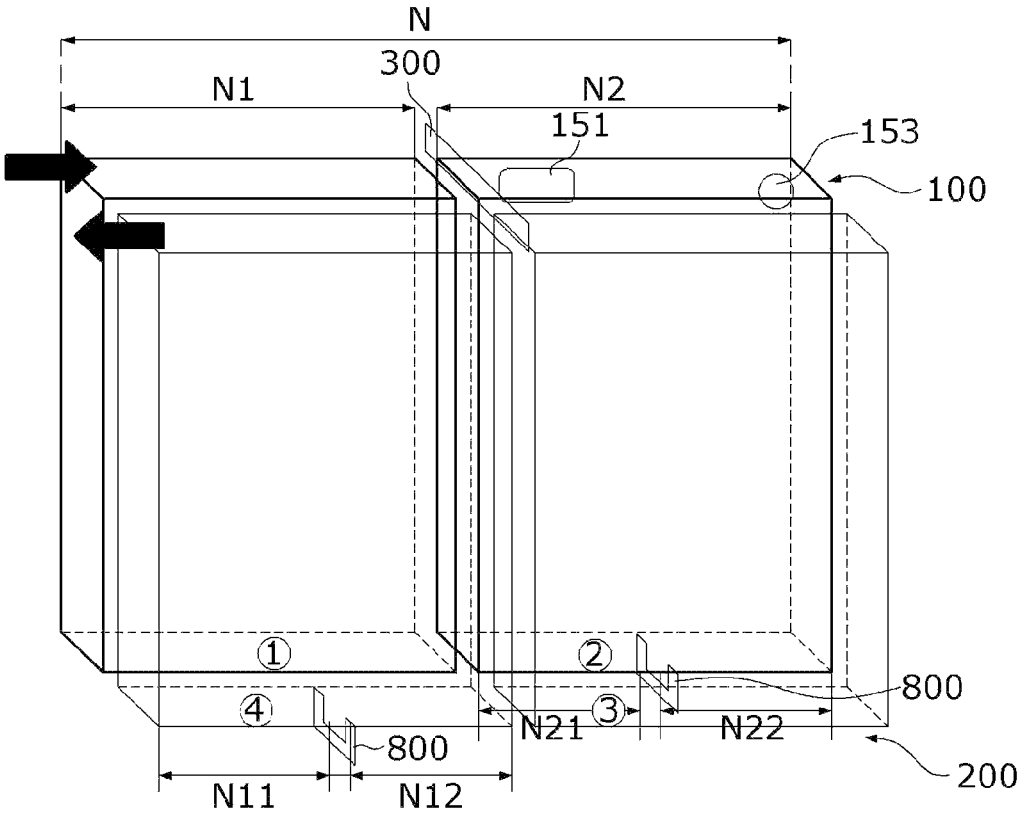
FIG. 26 is a view showing the structure of the flow path formed by FIG. 1.

FIG. 26 is a view showing the structure of the flow path formed by FIG. 1.

Referring to FIG. 26, the first header tank 100 may have a two-row structure through the first partition wall 150 and the second header tank 200 may have a two-row structure through the second partition wall 250. In this case, the baffle 300 is disposed in a certain region of the first header tank 100 to form a flow path.

As shown in FIG. 26, the refrigerant flowing into the first row of the first header tank 100 moves downward and then moves to the first row of the second header tank 200 to rise. Thereafter, the refrigerant moves from the first row to the second row of the first header tank 100, and the refrigerant moved to the second row descends and then moves along the second row of the second header tank 200 and then rises. Thus, it is discharged through the second row of the first header tank 100.

At this time, the second header tank 200 is divided into four zones by the baffle disposed in the first header tank 100, and the throttle 800 may be disposed in each of the first row and the second row of the second header tank 200.

The throttle 800 may be disposed in the second zone and the fourth zone of the second header tank 200, respectively.

In this case, the throttle 800 may be disposed at the center of the second and fourth zones.

In one embodiment, when the heat exchanger has a 33-row structure (N), the baffle 300 may be disposed in a region partitioning 15 rows (N1) and 18 rows (N2) based on the inflow side of the refrigerant. At this time, the throttles disposed in the second zone may be disposed to divide 9 rows (N21) and 9 rows (N22), and the throttle disposed in the fourth zone may be disposed at a position that divides 7 rows (N11) and 8 rows (N12).

In addition, when the heat exchanger has a 37-row structure (N), the baffle 300 may be disposed in a region partitioning 18 rows (N1) and 19 rows (N2) based on the inflow side of the refrigerant. At this time, the throttle disposed in the second zone may be disposed in the region that divides 10 rows (N21) and 9 rows (N22), and the throttle disposed in the fourth zone may be disposed in the region that divides 9 rows (N11) and 9 rows (N12).

As described above, the embodiment of the present invention has been described in detail with reference to the accompanying drawings.

The above description is merely illustrative of the technical idea of the present invention, and those of ordinary skill in the technical field to which the present invention pertains can make various modifications, changes, and substitutions within the scope not departing from the essential characteristics of the present invention. Accordingly, the embodiments disclosed in the present invention and the accompanying drawings are not intended to limit the technical idea of the present invention, but are for illustrative purposes, and the scope of the technical idea of the present invention is not limited by these embodiments and the accompanying drawings. The protection scope of the present invention should be interpreted by the following claims, and all technical ideas within the scope equivalent thereto should be construed as being included in the scope of the present invention.

EXPLANATION OF NUMERAL REFERENCES

100: First header tank
110: First header plate
111: Second end cap fixing hole
113: Tube coupling hole,
115, 135: Emboss
130: First tank
131: Concave portion
133: First end cap fixing hole
150: First partition wall
151: Main communication hole
153: Auxiliary communication hole
200: Second header tank
210: Second header plate
211: First throttle fixing hole
230: Second tank
231: Second throttle fixing hole
250: Second partition wall
300: Baffle
400: End cap
410: End cap plate
411: First fixing portion
412: Confusion prevention portion
413: Second fixing portion
415: Insertion groove
416: Close coupling portion
430: Inflow coupling protruding portion
431: Inlet
433: Coupling groove portion
450: Outlet coupling protruding portion
451: Outlet
500: Manifold
510: Inflow passage
511: Inflow passage protruding portion
512: Coupling protrusion
530: Outflow passage
531: Outflow passage protruding portion
600: First end plate
610: First fixing protrusion
620: First inclined portion
630: First central bending portion
640: First outer bending portion
700: Second end plate
710: Second fixing protrusion
720: Second inclined portion
730: Second central bending portion
740: Second outer bending portion
800: Throttle
810: Throttle hole
820: Third fixing portion
830: Fourth fixing portion
831: Fourth fixing groove

900: Core part
910: Tube
911: Upper wall
912: Lower wall
913: Flow hole
914: Partitioning wall
915: Outmost wall
916: Locking wall
930: Fin

What is claimed:

1. A heat exchanger comprising:

a first header tank and a second header tank that are disposed to be spaced apart a distance in a height direction; and a core part that is disposed between the first header tank and the second header tank and includes a plurality of tubes and fins, wherein the second header tank includes a second header plate, a second tank, and a second partition wall that divides a space formed by a combination of the second header plate and the second tank to form a plurality of flow paths, at least one throttle including a throttle hole is disposed in a flow path formed through the second partition wall, and the throttle is spaced apart from a left and right side of the second header tank, wherein an end cap is connected to one end of the first header tank, and the end cap includes an end cap plate, wherein the end cap plate is inserted and fixed inside the first header tank at a predetermined distance from the end of the first header tank, wherein the end cap plate is provided with a first fixing portion for fixing with the first header tank, wherein the first fixing portion is formed to span a first flow path and a second flow path partitioned by a partition wall, and wherein the first fixing portion is provided to have a step confusion prevention portion to prevent confusion with respect to an insertion direction.

2. The heat exchanger according to claim 1, wherein the throttle has a separation distance of 55 to 70 mm from one side of the second header tank.

3. The heat exchanger according to claim 1, wherein the throttle hole has a size of 10 to 20% of a total area of the throttle.

4. The heat exchanger according to claim 1, wherein the throttle is provided with a third fixing portion and a fourth fixing portion, wherein the third fixing portion is fixed to the second header plate, and wherein the fourth fixing portion is inserted and fixed to the second tank.

5. The heat exchanger according to claim 4, wherein the fourth fixing portion is provided with a fourth fixing groove, and a region of the second partition wall is inserted and fixed in the fourth fixing groove.

6. The heat exchanger according to claim 5, wherein a second throttle fixing hole into which the fourth fixing portion is inserted is disposed in the second tank, and the second throttle fixing hole is disposed to span a space partitioned by the second partition wall.

7. The heat exchanger according to claim 1, wherein each tube of the plurality of tubes includes a plurality of flow holes through a plurality of partitioning walls, and a thickness of an outermost wall of each tube of the plurality of tubes is thicker than a thickness of the partitioning wall.

8. The heat exchanger according to claim 7, wherein the thicknesses of the partitioning wall and the outermost wall have a ratio of 1:1.9 to 2.1.

9. The heat exchanger according to claim 8, wherein 13 to 15 flow holes are provided.

10. The heat exchanger according to claim 7, wherein a ratio of width and height of each tube of the plurality of tubes is 1:0.08 to 0.085.

11. The heat exchanger according to claim 1, wherein the first header tank and the second header tank have a two-row structure, and a baffle is disposed inside the first header tank to form a 4-pass flow path.

12. The heat exchanger according to claim 11, wherein one throttle is disposed in a first row and another throttle is disposed in a second row of the second header tank, respectively.

13. The heat exchanger according to claim 12, wherein the second header tank is divided into four zones through the baffle disposed in the first header tank, and one throttle is disposed in a second zone and another throttle is disposed in a fourth zone, respectively.

14. The heat exchanger according to claim 13, wherein the one throttle is disposed in a center of the second zone and the another throttle is disposed in the fourth zone.

* * * * *